United States Patent [19]

Smith

[11] Patent Number: 4,491,735

[45] Date of Patent: Jan. 1, 1985

[54] RESTRICTED ION SOURCE OF HIGH CURRENT DENSITY

[75] Inventor: Donald L. Smith, Westport, Conn.

[73] Assignee: The Perkin-Elmer Corporation, Norwalk, Conn.

[21] Appl. No.: 561,859

[22] Filed: Dec. 15, 1983

Related U.S. Application Data

[63] Continuation of Ser. No. 365,930, Apr. 5, 1982.

[51] Int. Cl.[3] ..... H01J 27/02

[52] U.S. Cl. ..... 250/423 R; 250/396 R

[58] Field of Search ..... 250/423 R, 396 R, 288; 313/361

[56] References Cited

U.S. PATENT DOCUMENTS

| | | | |
|---|---|---|---|
| 3,155,593 | 11/1964 | Warnecke et al. | 376/107 |
| 3,845,305 | 10/1974 | Liebl | 250/398 X |
| 3,937,958 | 2/1976 | Rusch et al. | 250/396 R X |
| 4,267,457 | 5/1981 | Nakagawa et al. | 250/288 X |

*Primary Examiner*—Alfred E. Smith
*Assistant Examiner*—Jack I. Berman
*Attorney, Agent, or Firm*—Thomas P. Murphy; Edwin T. Grimes

[57] ABSTRACT

Means are provided to produce plasma in a chamber. A diaphragm having an externally small aperture permits ions to flow out of the chamber. The ions are focused to produce an ion beam of high current density in a very small area.

5 Claims, 1 Drawing Figure

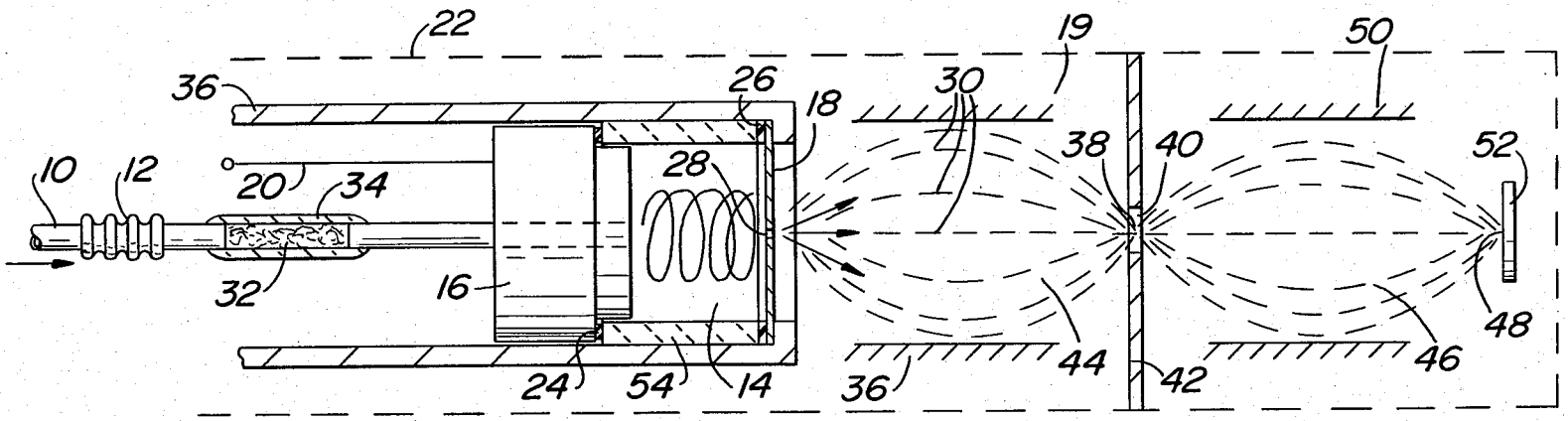
52
48
46
50
40
42
38
44
19
30
36
18
26
14
28
54
24
22
16
34
20
32
36
12
10

RESTRICTED ION SOURCE OF HIGH CURRENT DENSITY

This application is a continuation of application Ser. No. 365,930, filed Apr. 5, 1982.

BACKGROUND OF THE INVENTION

Ion beams have been used in the past for many purposes and have been generated in different ways. The ion beams have a number of uses. One such use involves secondary ion mass spectroscopy studies in which an object is bombarded with an ion beam to knock (sputter) particles off the surface of the object to permit analysis of the particles.

Ion beams are useful where it is desired to sputter or etch an object. The technique may be used for sputtering or milling very fine patterns in integrated circuitry. In some cases, plasma etching (dry etching) has been used to yield extremely fine patterns in wafers by a combination of ion and chemical removal of material.

OBJECTS OF THE INVENTION

It is an object of this invention to provide an ion source of small area and high current density.

It is a further object of this invention to provide an ion source of small area and high current density which permits refocusing of an ion beam and improvement in the performance of a differentially-pumped ion gun.

It is still a further object of this invention to provide an improved ion beam source in which the ion flux density at an object target is increased to permit increased rate of sputtering or etching of the object, and in which, in addition, the diameter of the ion beam at the target is reduced in order to increase spatial resolution of sputtered or etched patterns.

BRIEF SUMMARY OF THE INVENTION

In accordance with the present invention, means are provided to produce an ion source of high current density in a very small area. Gas, which is adapted to be ionized, is passed through a cathode electrode into a plasma chamber. Electrical power applied to the cathode electrode ionizes the gas. A diaphragm, which also acts as an anode electrode, includes a small aperture therein to permit ions to pass therethrough from the plasma chamber into a vacuum area. Focusing means are provided in the vacuum area to focus the ions into a narrow beam of high current density which may be used for sputtering or etching an object, for example.

Other objects and advantages of the present invention will be apparent and suggest themselves to those skilled in the art, from a reading of the following specification and claims, taken in conjunction with the sole FIGURE of the drawing.

BRIEF DESCRIPTION OF THE DRAWING

The sole FIGURE of the drawing is a schematic representation of one embodiment of the present invention.

DESCRIPTION OF THE INVENTION

Referring to the drawing, a source of gas capable of being ionized, which could be a reactive gas such as $Cl_2$, for etching applications, is supplied from a suitable source, not illustrated, to a conduit 10. The conduit 10, which may include a compressed metal bellows 12 is connected through insulating means 32 and 34 to a plasma chamber 14. The plasma chamber 14 is disposed between a cathode electrode 16 and an anode electrode 18.

A source of electrical power, which may comprise radio frequency (R.F.) power, is connected to the cathode 16 through a power lead 20. The R.F. energy ionizes the gas and produces plasma in the plasma chamber 14. Direct current power or low frequency power may be used in place of the R.F. power in some situations.

The chamber 14 is sealed from a surrounding vacuum area 19, which may be provided within a suitable enclosure 22, by seals 24 and 26 which could be indium gaskets, for example, and which are compressed by the spring action of bellows 12. The enclosure may be a glass tube or other conventional vacuum housing. The anode 18 comprises a diaphragm type member and includes a pinhole aperture 28 therein. The aperture 28 permits effusion of the ions from the plasma chamber 14 into the vacuum area 19. The effusion of the ions after passing through the aperture 28 is represented by lines 30.

The beam-generating plasma chamber may typically comprise 1.1 cm diameter metal electrodes spaced 0.5 cm apart by an electrically insulating cylinder 54, giving a volume of 0.48 cm.

The plasma generated in the plasma chamber 14 may be maintained at a constant pressure of, for example, 0.01 to 10 Torr by the balance between the area of the aperture 28 and the supply rate of gas through the conduit 10. Up to 10 watts/cm$^2$ of R.F. power may be applied to the cathode 16 without spurious gas breakdown elsewhere when insulating means are used such as when a glass wool packing 32 is in a glass enclosure 34. A grounded cylinder 36, which may be silver plated copper, provides shielding for the R.F. energy and prevents it from being emitted to the surrounding environment, and also retains the insulating cylinder 54 and the seals 24 and 26 in place against the cathode 16. The anode or counterelectrode 18 may comprise metal, such as magnesium, which is also at ground potential so that the R.F. energy is completely enclosed.

The aperture 28 in the diaphragm or anode 18 in effect samples the plasma, which then enters into the vacuum downstream from the current flow. The size of the aperture may be typically 1 to 100 micrometers in diameter, depending on the ion current and focused spot size desired and pumping capacity available. In some cases, apertures as small as one quarter micrometer in diameter may be used when the anode diaphragm thickness is also this dimension or less. The limiting factor to the minimum size of the aperture relates to the thickness of the material of the anode. The size of the aperture should be equal to or greater than this thickness to prevent bombardment of the ions on the edges of the aperture as they pass therethrough. Such bombardment would sputter-erode the aperture and would also cause loss of ion current by neutralization.

For a given gas, the ion current may be maximized by adjustment of the pressure in the plasma chamber 14, the R.F. power and frequency, the spacing between the cathode 16 and anode 18, and by magnetic confinement of the plasma electrons. This last technique is not illustrated in the drawing, but is established prior art.

The effusing of the ions from the opening 28 would normally contain neutral molecules and atoms, both ground-state and excited-state, as well as electrons and ions. The ions effusing from the opening 28 may be refocussed by a lens 36. The lens 36 may be a conventional electrostatic lens, which refocuses the ions towards a focal point 38. The focal point 38 could be a target or object to be milled or sputtered. In the embodiment illustrated, however, a higher vacuum environment is provided downstream of the focal point 38 in region 46, where the ions are free of most of the neutrals present in area 44. The lens focuses the ions and not the neutrals. Because the effusing neutrals do not assist the use of the ions and only produce undesired back pressure of gas, they may be removed by a differential vacuum pump evacuating region 44, such pump not illustrated in the drawing. The beam of ions at focal point 38 is directed through an opening 40 in a plate 42. The plate 42 separates the differentially pumped area 44 from a downstream higher vacuum area 46. The ions effusing from the opening 38 are refocused to a focal point 48 by a second electrostatic lens 50.

Sputtering or etching of a target 52 may be produced by the ions at the focal point 48. Raster scanning of the focal point or writing of milled patterns are made possible by addition of standard electrostatic deflection electrodes in region 46. The focal point 38 could be scanned similarly by the incorporation of such electrodes in region 44. By use of smaller apertures in the anode, as disclosed in the present invention, and of magnifying ion optics, it is possible to generate submicron-diameter ion beams for microlithographic work such as for very high speed integrated circuit (VHSIC) patterning or for high spatial resolution secondary ion mass spectroscopy.

What is claimed is:

1. Means for producing an ion source having a relatively small area comprising:

(a) a source of gas subject to becoming ionized, (b) a plasma chamber comprising:

a cathode, an anode, an insulating cylinder disposed between one end of said cylinder and said cathode, first seal means disposed between one end of said cylinder and said cathode, second seal means disposed between the other end of said cylinder and said anode, a grounded cylinder disposed about said plasma chamber retaining said insulating cylinder and said first and second seal means in place against said cathode, (c) conduit means for directing said gas into said plasma chamber, (d) bellows means disposed in said conduit means for biasing said cathode toward said anode to compress said first and second seal means, (e) a source of electrical power for ionizing said gas to produce plasma in said plasma chamber, (f) a first vacuum chamber enclosing said plasma chamber, (g) said anode forming a diaphragm having an aperture formed therein to permit said ions to pass therethrough from said plasma chamber into said first vacuum chamber, (h) first means disposed in said first vacuum chamber for focussing the ions effusing from said aperture to produce a focussed beam of ions of relatively high current density in a relatively small area, (i) a second vacuum chamber connected to said first vacuum chamber for receiving said ions from said first vacuum chamber, (j) a plate separating said first and second vacuum chambers and having an aperture to permit passage of said focussed ions from said first vacuum chamber into said second vacuum chamber, and (k) second means in said second vacuum chamber for refocussing the ions passing through the aperture in said plate to produce a refocussed beam of ions.

2. Means as set forth in claim 1 wherein the size of said aperture in said diaphragm is equal to or larger than the thickness of said diaphragm to minimize ions bombarding the edges of said aperture when passing therethrough.

3. Means as set forth in claim 2 wherein said means for focusing comprise electrostatic lenses.

4. Means as set forth in claim 3 wherein said source of electrical power comprises a source of radio frequency power.

5. Means as set forth in claim 4 wherein said cylindrical shield is provided around said cathode electrode to shield environment from said radio frequency power.

* * * * *